United States Patent [19]

Thorsheim

[11] 4,258,862

[45] Mar. 31, 1981

[54] LIQUID DISPENSER

[76] Inventor: Ivar Thorsheim, Box 242S, Oslo 1, Norway

[21] Appl. No.: 52,239

[22] Filed: Jun. 26, 1979

[51] Int. Cl.[3] ..... B67D 5/08

[52] U.S. Cl. ..... 222/56; 222/105; 222/107

[58] Field of Search ..... 118/694, 401; 222/56, 222/67, 386.5, 94, 105, 107, 64; 137/453

[56] References Cited

U.S. PATENT DOCUMENTS

| | | | |
|---|---|---|---|
| 21,761 | 10/1850 | Keane | 222/386.5 |
| 148,297 | 3/1874 | Heggam | 222/386.5 |
| 2,321,836 | 6/1943 | Marzo | 222/386.5 |
| 2,879,785 | 3/1955 | Vesterdgl | 222/386.5 |
| 3,677,444 | 8/1972 | Merrill | 222/386.5 |
| 3,862,708 | 1/1975 | Waxlex | 222/386.5 |
| 4,174,741 | 11/1979 | Parson | 222/386.5 |

FOREIGN PATENT DOCUMENTS

| | | | |
|---|---|---|---|
| 58419 | 8/1891 | Fed. Rep. of Germany | 222/386.5 |

*Primary Examiner*—Sam Silverberg

*Attorney, Agent, or Firm*—Watson, Cole, Grindle & Watson

[57] ABSTRACT

A device for dispensing liquids such as paint, lacquer, glue and the like containing solvents which evaporate in air at room temperature, includes an outer rigid shell forming an enclosure for an inner flexible bag or container. The bag has an outlet orifice coincident with an outlet opening provided in the bottom wall of the outer shell, and an air inlet communicates with the interior of only the enclosure for establishing an atmospheric pressure therewithin so as to permit the dispensing liquid to flow outwardly of the outlet opening. The outlet may be closed by a shut-off valve so as to create a sub-atmospheric pressure level within the enclosure to thereby interrupt the liquid flow from the device. Otherwise, the air inlet may be closed when its outer end becomes submerged in a quantity of water contained within a receptacle and divided by a flexible diaphragm from the dispensed liquid. The water level changes in response to changes in the supply of dispensing liquid in the receptacle as an applicator roll coats products with the dispensed liquid.

1 Claim, 2 Drawing Figures

18
12
16
17
17
13
21
10
11
L
19
14
P
22
15
C 12
23

13
18
21
11
26
L
14
19
25
24
L
31
W
27
29
28
P

LIQUID DISPENSER

BACKGROUND OF THE INVENTION

This invention relates generally to a liquid dispenser, and more particularly to such a dispenser for liquids such as paint, lacquer, glue or the like containing solvents which evaporate in air at room temperature.

These liquids, i.e., such as paint, lacquer, glue or the like, are difficult to effectively dispense because of the frequent clogging of the outlet nozzle thereby causing considerable downtime during the dispensing operation. Also, such dispensers are typically provided with means for pressurizing the liquid container to induce dispensing, as well as with shut-off means at the outlet end. Such components only add to the overall cost of the dispensing operation. And, the cleaning of the dispensing containers with suitable solvents, typically required for the prior art devices after each dispensing operation, is time consuming and costly.

SUMMARY OF THE INVENTION

It is therefore an object of the present invention to provide a device for the dispensing of liquids such as paint, lacquer, glue or the like containing solvents which evaporate in air at room temperature, which avoids many of the problems experienced with the use of prior art dispensers for such types of liquids by, for example, eliminating the need for expensive and complex pressure lines and outlet shut-off means, by avoiding the problems with clogging and the need for cleaning the dispensing tank after each operation.

A further object of this invention is to provide such a device as having a flexible inner bag located within an outer rigid shell, both the bag and shell having coincident outlet openings at the bottom of the shell, and an air inlet being provided on the shell for establishing pressure at an atmospheric level within the shell behind the bag. Liquid within the bag may therefore be dispensed through the outlet, and such dispensing is interrupted by closing the air inlet to thereby create a sub-atmosphereic level of pressure within the outer shell.

In accordance with one embodiment of the invention, a brush applicator or the like is mounted on the outer shell at the outlet opening, and the air inlet is in the form of a flexible hollow tube which may be crimped closed by some suitable closing valve.

In accordance with another embodiment, an open pan is associated with an applicator roll and a flexible diaphragm separates the pan into a water compartment and into a dispensing liquid compartment which functions as a fountain. The air inlet, in the form of a hollow tube, is closed as its open end becomes submerged when the water level rises in response to an increased level of the dispensing liquid upon the demand placed on the dispenser.

Other objects, advantages and novel features of the invention will become more apparent from the following detailed description of the invention when taken in conjunction with the accompanying drawing.

DETAILED DESCRIPTION OF THE INVENTION

Figure 1:
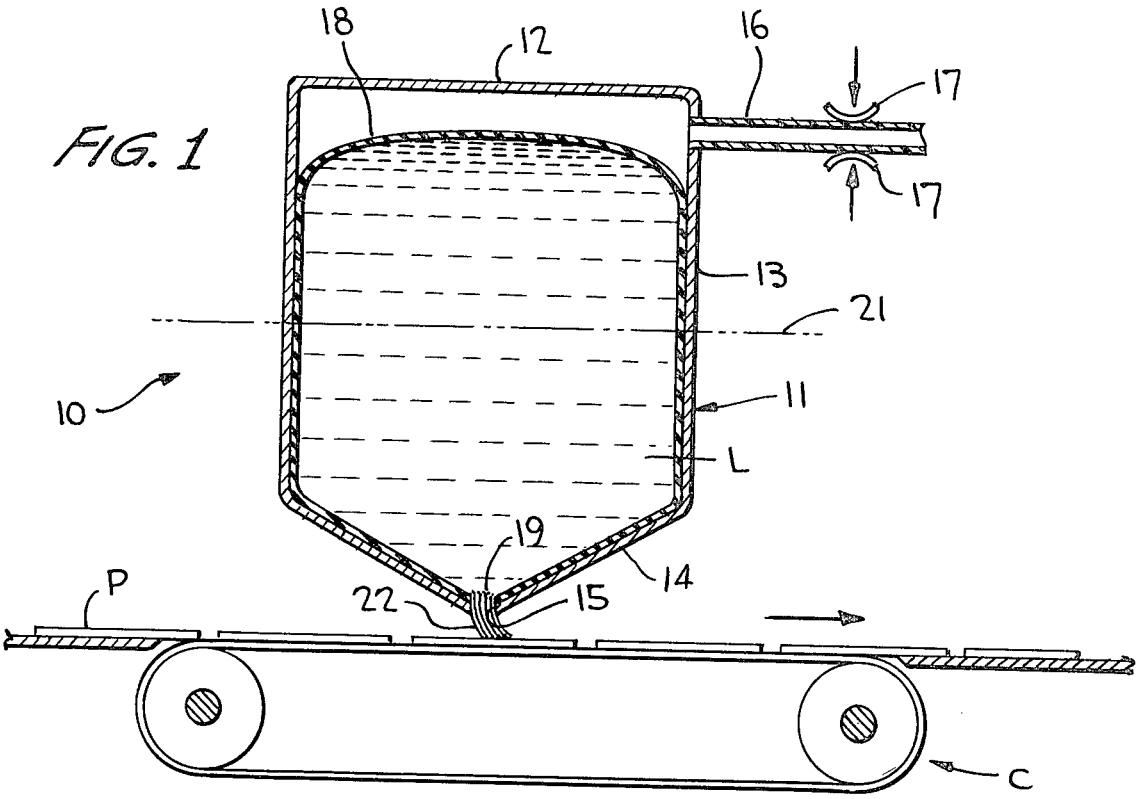
FIG. 1 is a vertical sectional view of one embodiment of the present invention.

Turning now to the drawings wherein like reference characters refer to like and corresponding parts throughout the several views, a dispensing device generally designated 10 is shown in FIG. 1 as comprising an outer rigid shell or enclosure 11 having a top wall 12 interconnected with a cylindrical side wall 13 which is interconnected with a conical bottom wall 14. The bottom wall has an outlet opening 15 therein, and an air inlet in the form of a hollow tube 16 is mounted on the shell. This tube may be of flexible material such as an elastomeric of some type which is capable of being easily crimped for closing the air inlet as by means of a pair of opposing crimp valve elements 17 when moved together in the direction of the arrows as shown in FIG. 1. Alternatively, tube 16 may be rigid and may be operated by some suitable valve opening and closing means.

The device further includes an inner flexible bag or container 18 having an outlet orifice 19 coincident with outlet opening 15, the bag being collapsible or stretchable and being filled with a quantity of dispensing liquid L, such as paint, lacquer, glue or the like containing solvents which evaporate in air at room temperature. Device 10 is mounted in place in any normal manner, and may be capable of being pivoted about a horizontal axis 21 thereof into a position whereby wall 14 is uppermost. A portion of the container adjacent its outlet orifice 19 may be secured to the inner surface of the outer shell so that the container may be filled through outlet opening 15 with the device pivoted into a position with its bottom wall uppermost. A removable brush applicator 22 is snap-fitted or otherwise removably secured in place within outlet opening 15 so as to extend into outlet orifice 19 and outwardly of bottom wall 14, as illustrated in FIG. 1. The brush applicator is of some suitable type permitting its bristles to become wetted during the dispensing operation for applying a coating of liquid L onto the top surfaces of products P which are moved in the direction of the arrow by means of an endless conveyor C.

In operation, after the bag or container 18 is filled with liquid L to be dispensed, applicator 22 is mounted in place and the air inlet tube is squeezed closed until the liquid is ready to be dispensed. Thus, with the device in its position of FIG. 1, crimp valve elements 17 are opened to establish an atmospheric pressure level within the outer shell behind container 18 thereby exerting pressure against the container and allowing its liquid contents to flow by gravity out of the outlet opening and into the brush applicator for thereby effecting a coating of the top surfaces of products P. When it is desired to cease further dispensing of the liquid, crimp valve elements 17 are simply moved toward one another in the direction of the arrows for crimping inlet tube 16 closed thereby creating a sub-atmospheric pressure level within the outer shell and thus interrupting the further dispensing of liquid. Elements 17 may be operated manually or by some automatic means (not shown) if desired. Also, a spherical ball applicator may be utilized in lieu of the brush applicator shown in the drawing. In any event, the applicator may simply be removed between dispensing operations and placed in a solvent to avoid hardening. It should also be pointed out that bottom wall 14 of the outer shell may comprise a pair of downwardly sloping flat plates defining an elongated slit therebetween of some predetermined length for spreading the liquid across the products to be coated. The brush applicator may thus be of a corresponding size equal to that of the elongated slit for applying the dispensed liquid, or a cylindrical applicator roll may be utilized instead. The dispensing liquid operation is nevertheless the same since each time the air inlet is closed for reducing the interior of the outer shell to a sub-atmospheric level, the dispensing through the outlet opening is interrupted. It should be further pointed out that alternate types of valve means may be utilized for closing and opening the air inlet.

Figure 2:
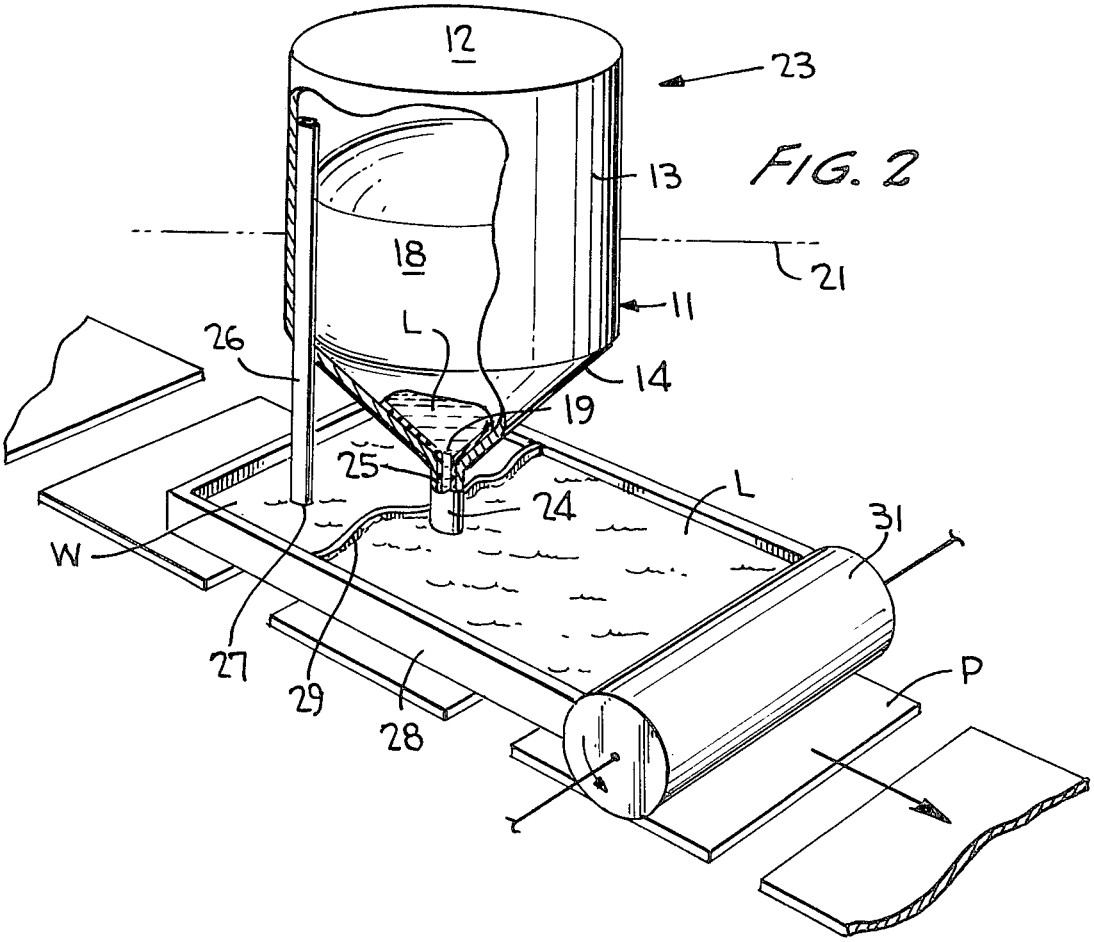
FIG. 2 is a perspective view, in part section, of another embodiment according to the invention.

In accordance with another embodiment of the invention shown in FIG. 2, a dispensing device generally designated 23 is substantially the same as device 10 except that bottom wall 14 has an outwardly extending nozzle 24 thereon. And, outlet orifice 19 of the container is provided with a neck 25 in engagement throughout the opening of the nozzle and may be secured thereto. An air inlet tube 26 is mounted on the outer shell and extends from behind container 18 outwardly of the outer shell. This tube is hollow and open-ended so that, upon closing its lower open end 27, the pressure within the outer shell behind container 18 will be reduced to subatmospheric. Such a valving operation is carried out by means of an open tray 28 having a diaphragm 29 of flexible material secured to the bottom wall and to opposing side walls of the tray. A quantity of water W is contained within the tray at one side of the diaphragm and beneath open end 27 of the air tube, while a quantity of the dispensed liquid is contained within the tray at the opposite side of the diaphragm. A portion of the tray containing liquid L therefore forms a fountain for the dispensing liquid which wets the surface of an applicator roll 31 mounted for rotation (by some suitable means, not shown) in the direction of its arrow shown in FIG. 2. Hence, the upper surfaces of products P are coated with liquid L as the products pass beneath the applicator roll in a forward direction of travel shown by the arrow in FIG. 2.

The level of the water within the open tray is such that open end 27 of the air inlet tube will be submerged in the water upon a slight movement of the diaphragm toward the air tube thereby causing the water level to slightly rise. Thus, the air tube will be closed off to the atmosphere and the pressure within the outer shell will be reduced to subatmospheric thereby interrupting gravity flow of the liquid from container 18 through nozzle 24. Thus, as the dispensing liquid within the open tray is applied to the products to be coated via the applicator roll, its level within the tray recedes thereby allowing the quantity of water at the outer side of the diaphragm to slightly move the diaphragm away from the air inlet tube whereby the water level slightly recedes sufficiently to expose open end 27 of the tube to the atmosphere. The pressure within the outer shell is accordingly increased to an atmospheric level thereby forcing container 18 to contract and allowing the liquid to flow by gravity out through the nozzle 24 disposed directly over the fountain portion of the tray. The level of dispensing liquid L then slightly increases so that the additional pressure thereof exerted against the diaphragm causes it to again move slightly toward tube 26 to cause the water level to slightly raise for again shutting off the tube as its open end 26 becomes submerged in the water. Dispensing liquid is thus replenished in the tray upon the demand made by applicator roll 31. Therefore, depending on the rate at which the dispensed liquid is applied to the products, the amount of liquid dispensed into the fountain will vary therewith accordingly. It should be pointed out that the levels of the liquid and the water initially in the tray prior to the dispensing operation are chosen to achieve the aforedescribed movement of the diaphragm for effecting an opening and closing of the open end of the air tube.

From the foregoing it can be seen that the devices according to the invention are simple and economical yet highly effective in dispensing liquids such as paint, lacquer, glue, etc. which contain solvents which evaporate in air at room temperature, without the need for cleaning of the dispensing containers between operations and without contending with pressure lines and with clogged dispensing nozzles as heretofore required. Container 18 may be in the form of an elastic balloon easily insertible in its collapsed condition within the outer shell through the outlet opening thereof, and may be secured in place to some portion of the outer shell if desired. Or, container 18 may be of flexible and inelastic material in which case one of the walls of shell 11 would be made removable to facilitate insertion of the container therewithin.

When the dispensing device is rotated about its horizontal axis until its bottom wall 14 is uppermost, container 18 may be filled with liquid L to be dispensed thereby causing the balloon to stretch until it nearly fills the outer shell. The air inlet tube is then closed, the device is rotated into its dispensing position, and the air tube is then opened to cause the dispensing liquid to be effectively drained from its container as the atmospheric pressure level within the outer shell allows the container to contract. Interruption of the dispensing operation is carried out by simply closing off the air inlet tube to the atmosphere thereby creating a subatmospheric level of pressure within the outer shell behind the balloon. The dispensing may be interrupted each time the air inlet tube is closed by either actuation of the crimp valve elements of FIG. 1 or by the increase of the water level in response to an increase in the dispensing liquid level of FIG. 2.

Obviously, many other modifications and variations of the present invention are made possible in the light of the above teachings. It is therefore to be understood that within the scope of the appended claims the invention may be practiced otherwise than as specifically described.

I claim:

1. A device for dispensing liquids such as paint, lacquer, glue and like containing solvents which evaporate in air at room temperature, comprising a hollow closure of rigid material having a bottom, side and top walls, an outlet opening in said bottom wall, a collapsible container disposed within said enclosure, said container being of flexible material adapted to be filled with one of the dispensing liquids, said container having an outlet orifice coincident with said outlet opening, an air inlet communicating with the interior of only said closure for establishing an atmospheric pressure within said closure, said air inlet comprising an open-ended tube mounted on said enclosure for establishing an atmospheric pressure within said closure, and means for closing only said tube to create a sub-atmospheric pressure level within said closure, said closing means comprising an open pan and an applicator roll associated therewith, a flexible diaphragm mounted on said pan defining a receptacle on one side thereof for a quantity of water and defining a fountain on the opposite side thereof for a quantity of liquid to be dispensed, said tube being spaced from a bottom wall of said receptacle, whereby the level of the water in said receptacle changes relative to the amount of liquid remaining in said fountain while being dispensed by said applicator so as to thereby accordingly open and close said open end of said tube for controlling the flow of liquid therethrough.

* * * * *